US008146911B2

(12) United States Patent
Kozaki

(10) Patent No.: US 8,146,911 B2
(45) Date of Patent: Apr. 3, 2012

(54) SHEET FEEDING DEVICE AND IMAGING APPARATUS EMPLOYING SHEET FEEDING DEVICE

(75) Inventor: Daisuke Kozaki, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 111 days.

(21) Appl. No.: 12/721,959

(22) Filed: Mar. 11, 2010

(65) Prior Publication Data

US 2011/0049783 A1 Mar. 3, 2011

(30) Foreign Application Priority Data

Aug. 31, 2009 (JP) ..... 2009-200609

(51) Int. Cl.
*B65H 5/22* (2006.01)

(52) U.S. Cl. ..... 271/4.01; 271/4.02; 271/4.03; 271/10.02; 271/10.03; 271/10.04; 271/110; 271/258.03; 271/258.04; 271/262; 271/263; 271/265.04

(58) Field of Classification Search ..... 271/4.01–4.03, 271/10.02–10.04, 258.03, 258.04, 110, 152–155
See application file for complete search history.

(56) References Cited

U.S. PATENT DOCUMENTS

| | | | | |
|---|---|---|---|---|
| 5,384,631 | A | 1/1995 | Matsunami | |
| 5,423,526 | A * | 6/1995 | Hasegawa | 271/10.13 |
| 6,109,522 | A * | 8/2000 | Force et al. | 235/379 |
| 7,690,650 | B2 * | 4/2010 | Itoh et al. | 271/263 |
| 7,793,928 | B2 | 9/2010 | Ohama et al. | |
| 7,905,484 | B2 * | 3/2011 | Komuro | 271/263 |
| 2005/0194731 | A1 | 9/2005 | Ohama et al. | |
| 2009/0189328 | A1 | 7/2009 | Ohama et al. | |

FOREIGN PATENT DOCUMENTS

| | | |
|---|---|---|
| JP | 03-031148 | 2/1991 |
| JP | 04-075944 | 3/1992 |
| JP | 4-79836 U | 7/1992 |
| JP | 06-219600 | 8/1994 |
| JP | 07-109039 | 4/1995 |
| JP | 09-077272 | 3/1997 |
| JP | 09-110220 | 4/1997 |
| JP | 2001-158538 | 6/2001 |
| JP | 2004-149235 | 5/2004 |
| JP | 2005253013 A | 9/2005 |

OTHER PUBLICATIONS

JP Office Action of Jun. 28, 2011, for corresponding JP application 2009-200609.

* cited by examiner

*Primary Examiner* — Kaitlin Joerger
*Assistant Examiner* — Prasad Gokhale
(74) *Attorney, Agent, or Firm* — Banner & Witcoff, Ltd.

(57) ABSTRACT

A sheet feeding device includes a sheet feed tray, a chute having first and second guides, first and second rollers arranged on the first guide, first and second contact members protruded from the second guide and urged to contact the first and second rollers, respectively, and a sheet sensor arranged between the first roller and the second roller. A controller controls a motor to rotate the first and second rollers in a first direction in which the sheet is fed from the second roller to the first roller when the controller receives a signal from the sensor, and controls the motor to stop the rotation of the first and second rollers when the signal from the sensor is terminated, and then rotate the first and second rollers in a second direction in which the sheet is fed from the first roller to the second roller.

7 Claims, 6 Drawing Sheets

SHEET FEEDING DEVICE AND IMAGING APPARATUS EMPLOYING SHEET FEEDING DEVICE

CROSS-REFERENCE TO RELATED APPLICATION

This application claims priority under 35 U.S.C. §119 from Japanese Patent Application No. 2009-200609 filed on Aug. 31, 2009. The entire subject matter of the application is incorporated herein by reference.

BACKGROUND

1. Technical Field

The following descriptions relate to an ADF (Automatic Document Feeder) configured to feed a plurality of stacked sheets placed on a sheet tray to a feed path one by one, an imaging apparatus employing such an ADF, and a method of feeding the sheets.

2. Prior Art

Conventionally, imaging apparatuses such as a copier, a scanner, a printer, an MFD (multi-function device) having multiple functions of the copier, scanner and/or printer, employing an ADF (auto document feeder) have been known. The ADF is configured to feed a plurality of stacked sheets placed on a sheet feed tray, one by one, to a sheet feed path. Such an ADF typically has a function to automatically separate one sheet from the stacked multiple sheets and feed the separated sheet to the sheet feed path.

SUMMARY OF THE INVENTION

Such a conventional ADF has following problems. When a user placed the stacked multiple sheets on the sheet feed tray, the leading ends of the multiple sheets are caught by a nip at a sheet pick-up roller and a nip at a sheet separation roller, and multiple sheets are fed without being separated. Another problem is that, when the multiple sheets are original documents for scanning or copying and the ADF is configured to feed, for example, the lowermost sheet of the stacked sheets, a second or third lower sheet may be fed before the lowermost sheet is fed, and an order of original sheets to be processed is reversed. To deal with the above problems, in the conventional ADF, the feed roller is reverse-rotated by a predetermined amount in order to move back the original sheets caught by the nips.

It is noted that the length of the original sheets entering in the nips at the pick-up roller and the separation roller varies depending on the user's operation. Therefore, in order to ensure that the original sheets are returned to a position on the upstream side of the nip, the feed roller should be reverse-rotated assuming that the length of the original sheets caught by the nip has a maximum possible amount. Such a configuration results in elongation of waiting time until the original sheet is normally fed.

The ADF and imaging apparatus according to the embodiment of the invention are advantageous in that separation of one sheet from the multiple sheets is ensured for sheet feeding, while the waiting time is minimized.

According to aspects of the invention, there is provided a A sheet feeding device configured to feed a stacked sheets one by one, including a sheet feed tray configured to hold a plurality of sheets stacked on the sheet feed tray, a chute having a first guide and a second guide opposing to the first guide, a first roller arranged on the first guide with at least part of a roller surface thereof being exposed, a first contact member arranged to protrude from the second guide, the first contact member being urged so as to contact the first roller, a second roller arranged on first guide with at least part of the second roller being exposed, a second contact member arranged to protrude from the second guide surface, the second contact member being urged so as to contact the second roller, a motor coupled to the first roller and the second roller for rotating the first roller and the second roller, a sensor arranged between the first roller and the second roller and configured to send a signal when the sensor detects a sheet, and a controller coupled to the motor and the sensor. The controller is configured to control the motor to rotate the first roller and the second roller in a first direction in which the sheet is fed from the second roller to the first roller when the controller receives a signal from the sensor, the controller controlling the motor to stop the rotation of the first roller and the second roller when the signal from the sensor is terminated, and then rotate the first roller and the second roller in a second direction in which the sheet is fed from the first roller to the second roller.

According to further aspects, there is provided an imaging apparatus, which is provided with a sheet feeding device configured to feed a plurality of sheets used in the imaging apparatus, and a scanning unit which is described above.

According to further aspects, there is provided a method of feeding a plurality of sheets stacked on a sheet feed tray one by one in a first direction to introduce the sheet into a device with use of a first roller and a second roller arranged inside the device along the first direction. The method includes a step of feeding the sheet in a second direction opposite to the first direction, a step of continuing the sheet feed in the second direction if a presence of the sheet at a predetermined position defined between the first roller and the second roller is detected and a predetermined period has not elapsed since the feeding of the sheet in the second direction is started, a step of terminating the sheet feed in the second direction if the presence of the sheet at the predetermined position is detected and the predetermined period has elapsed since the feeding of the sheet in the second direction is started, a step of terminating the sheet feed in the second direction if an absence of the sheet at the predetermined position is detected before the predetermined period has elapsed since the feeding of the sheet in the second direction is started, and a step of feeding the sheet in the first direction if the sheet feed in the second direction is terminated as the absence of the sheet at the predetermined position is detected before the predetermined period has elapsed since the feeding of the sheet in the second direction is started.

BRIEF DESCRIPTION OF THE ACCOMPANYING DRAWINGS

DETAILED DESCRIPTION OF THE EMBODIMENT

Figure 1:
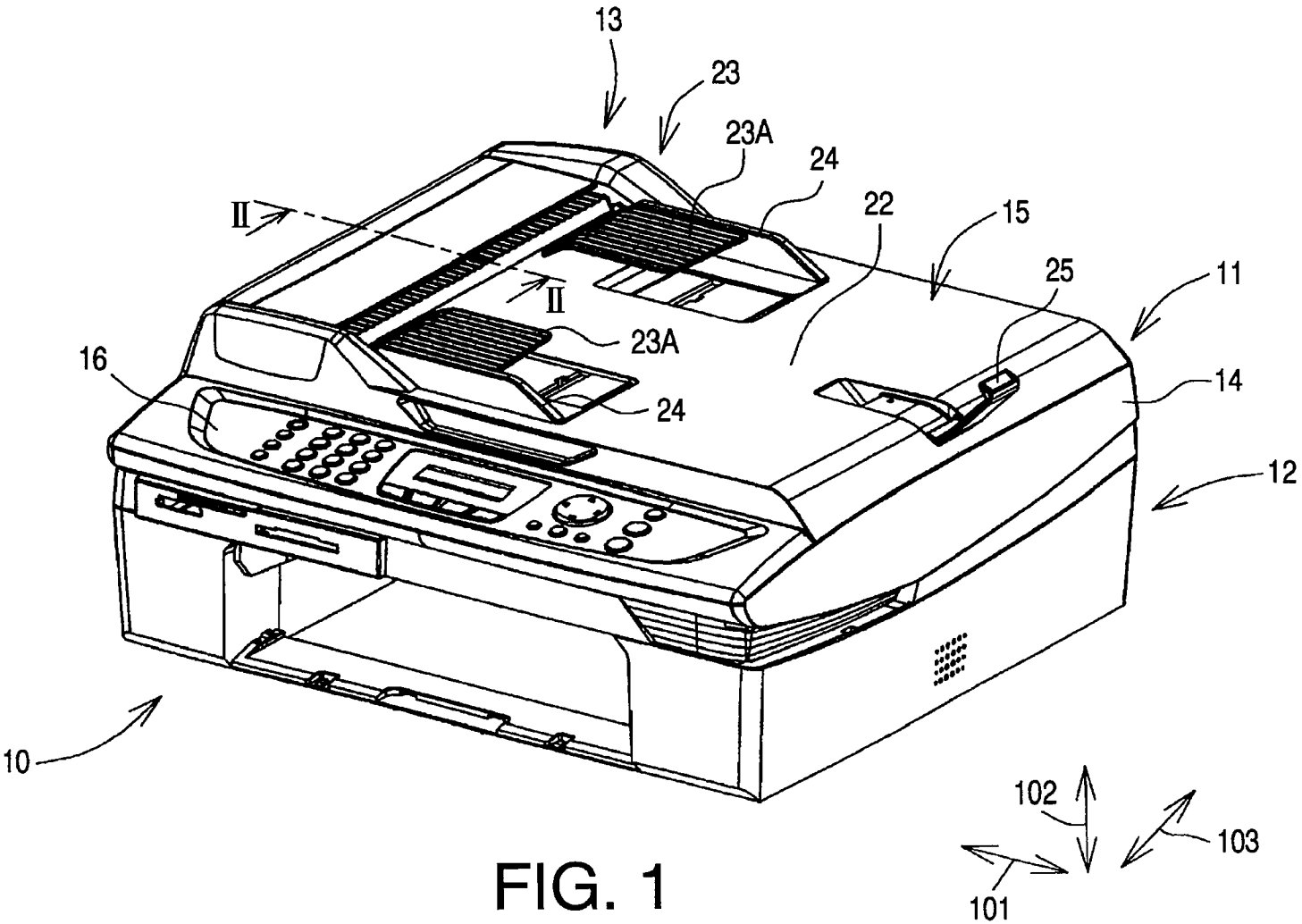
FIG. 1 is a perspective view of an MFD (multi-function device) according to embodiment of the invention.

Hereinafter, referring to the accompanying drawings, an MFD (multi-function device) 10 according to an embodiment of the invention will be described in detail. It should be appreciated that the MFD 10 described hereafter is only an exemplary embodiment, and can be modified in various ways without departing from the scope of the invention.

The MFD 10 according to the embodiment is configured to perform a scanner function, a printer function and a facsimile function. The MFD 10 can be used by itself, without being connected with other device. Further, the MFD 10 can also be used, when it is connected with a PC (Personal Computer), as a peripheral of the PC.

An upper portion of the MFD 10 is a scanner section 11 for scanning images of originals. A lower portion of the MFD 10 is a printer section 12 for printing images on recording sheets. The scanner section 11 employs an ADF (Auto Document Feeder) 13. It should be appreciated that the printer section 12 according to the embodiment does not employ the ADF. Therefore, although the MFD 10 will be described as an embodiment of the invention, a device which does not have the printer function and/or the facsimile function could be another embodiment that employs the AFD.

The scanner section 11 has a scanning device 14 which serves as an FBS (FlatBed Scanner). An original holding cover 15 provided with the ADF 13 is secured to the scanning unit 11 with hinges at a rear side of the scanning device 14 so that a user can open/close the original holding cover 15 with respect to the scanning device 14 freely.

The scanning device 14 is formed integrally with a casing of the MFD 10. On an upper surface of the scanning device 14, a platen glass is provided. The platen glass faces the original holding cover 15. Inside the scanning device 14, an image scanning unit 21 is provided so as to face the platen glass. When the scanner section 11 is used as the FBS, the original holding cover 15 is opened, an original sheet is placed on the platen glass, then the original holding cover 15 is closed so that the original sheet is fixed on the platen glass. Thereafter, the image scanning unit 21 moves along the platen glass to scan an image on the original sheet placed on the platen glass. It should be noted that the FBS function is an exemplary function, and an MFD according to another embodiment of the invention may not have the FBS function.

On a front side of the scanning device 14, an operation panel 16 is provided. The operation panel 16 has various operation buttons and an LCD (Liquid Crystal Display). The MFD 10 operates in accordance with commands inputted through the operation panel 16. In addition, the MFD 10 can also operate in accordance with commands transmitted, via a printer driver or scanner driver, from a PC connected to the MFD 10.

As shown in FIG. 1, the ADF 13 is provided to the original holding cover 15. The ADF 13 functions such that one of a plurality of original sheets placed on a sheet feed tray 22 is automatically separated from the remaining sheets, and the thus separated sheet is fed through a sheet feed path 26 and finally ejected onto an ejection tray 23. During a sheet feed process by the ADF 13 as described above, the original sheet passes below a platen guide 43. At this stage, the image scanning unit 21 located below the platen guide 43 scans an image on the original sheet.

Figure 2:
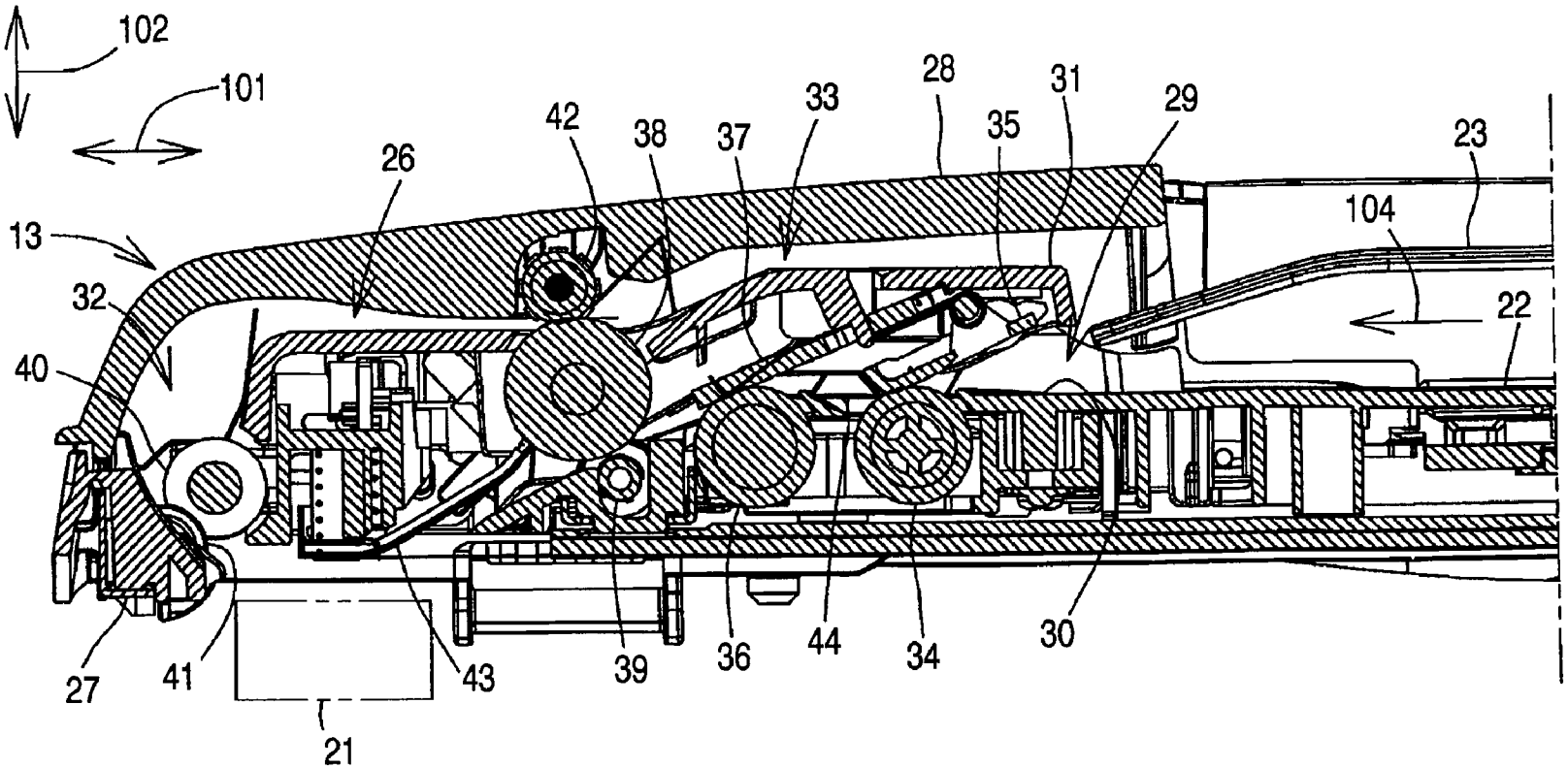
FIG. 2 shows an enlarged cross-sectional side view of the MFD taken along line II-II in FIG. 1.

As shown in FIGS. 1 and 2, the sheet feed tray 22 and the sheet ejection tray 23 are mounted on the original holding cover 15, the sheet ejection tray 23 being arranged above the sheet feed tray 22. Specifically, in the exemplary embodiment, the sheet feed tray 22 is formed integrally with the upper surface of the original holding cover 15. The original sheets to be scanned using the ADF 13 are placed on the sheet feed tray 22 in a stacked state with leading edges, in a feeding direction 104, are inserted in the ADF 13.

As shown in FIG. 1, the sheet feed tray 22 is provided with a pair of original guides 24. The original guides 24 restrict widthwise positions of the original sheets. The two original guides 24 are spaced from each other in a front-rear direction 103. Both the two original guides 24 are configured to be movable in the front-rear direction 103. Specifically, one of the pair of original guides 24 is manually moved in the front-rear direction 103, the other is moved in an opposite direction, with a well-known associating mechanism.

The pair of original guides 24 are formed with a pair of plate members 23A which define the ejection tray 23. The ejection tray 23 (i.e., the plate members 23A) is spaced from the sheet feed tray 22 in a height direction 102. The original sheet ejected from the ADF 13 is held by the ejection tray 23 with both sides being held by the ejection tray 23, with being separated from the original sheets placed on the feed tray 22. The length of the ejection tray 23 in the sheet ejection direction (i.e., a direction along the width 101 of the MFD 10) is shorter than that of the original sheet. Therefore, the ejected original sheets are held by the ejection tray 23 such that the leading edges of the original sheets, in the sheet ejection direction, slightly hang down from the ejection tray 23 over the original sheet stacked on the sheet feed tray 23. As a result, the leading edges of the original sheets held by the ejection tray 23 overlap on the trailing end portions, in the sheet feed direction 104, of the original sheet stacked on the sheet feed tray 22. However, since the leading end portions of the original sheets of the sheet feed tray 22 and the trailing end portions, in the sheet ejection direction, of the original sheets on the ejection tray 23 are separated as the sheet feed tray 22 and the sheet ejection tray 23 have a two-tiered structure, the ejected sheets and the un-ejected sheets will not be mixed.

One side end portion, on the sheet feed tray 22, where the ADF 13 is not provided, an original sheet stopper 25 is provided. The original sheet stopper 25 is configured to be manually postured between an erected position and a prostrate position. When the stopper 25 is postured to the erected position, the stopper 25 protrudes from a plane of the upper surface of the sheet feed tray 22 as shown in FIG. 1, while when the stopper 25 is postured to the prostrate position, the stopper 25 does not protrude from the plane of the upper surface of the sheet feed tray 22 (i.e., the upper surface of the stopper 25 in its prostrate position is substantially on the same plane of the sheet feed tray 22). When the stopper 25 is in the erected position, when, for example, an original sheet which has a substantially same size of the sheet feed tray 22 is ejected from the ADF 13, the leading end of such a sheet abuts the stopper 25, thereby such a sheet is prevented, by the stopper 25, from slipping out of the sheet feed tray 22.

In the ADF 13, as shown in FIG. 2, the sheet feed path 26 is defined. The sheet feed path 26 has a laterally-facing U-shaped passage communicating from the sheet feed tray 22 to the sheet ejection tray 23. Specifically, the sheet feed path 26 is defined by the main body 27 of ADF 13, which main body 27 is integrally formed on the original holding cover 15, and an ADF cover 28 which is openably secured to the ADF main body 27.

A chute 29 of the ADF 13 is defined by a guide plate 30 and a partition plate 31 as a passage having a predetermined height (i.e., a distance between the guide plate 30 and the partition plate 31). The guide plate is integrally formed to the ADF main body 27 like an extension of the sheet feed tray 22, and the partition plate 31 is a board provided on an inner side of the ADF cover 28 (see FIG. 2). When the scanning is performed using the ADF 13, the stack of the original sheets are placed on the sheet feed tray 22 such that the leading edges of the original sheets to be scanned are inserted in the chute 29.

The sheet feed path 26 is formed to have a laterally-facing U-shape having a bending portion 32 and communicates from the chute 29 to an ejection chute 33. The bending portion 32 and the ejection chute 33 are formed to be a continuous passages having a predetermined height, defined by the ADF main body 27, ADF cover 28, the partition plate 31, etc. Thus, the original sheets placed on the sheet feed tray 22 are guided to the chute 29, fed to the bent portion 32, then ejected from the ejection chute 33 to the ejection tray 23.

Along the feed path 26, a sheet feeding mechanism for feeding the original sheet is provided. Specifically, there are provided a pick-up roller 34, a contact member 35, a separation roller 36 and a separation contact member 37, a first feed roller 38, a second feed roller 40, and pinch rollers 39, 41 and 42. The contact member 35 is press-contacted with the pick-up roller 34. The contact member 35 is press contacted with the separation roller 36. The pinch rollers 39 and 42 are press contacted with first feed roller 38. The pinch roller 41 is press contacted with second feed roller 40. It should be appreciated that the rollers, contact members and pinch rollers as described are ones employed in the exemplary embodiment, and the configuration can be modified in various ways. For example, the contact members may be replaced with pinch rollers, and the number and arrangement of the rollers can be changed.

The pick-up roller 34 is arranged at a substantially central position, in the width direction 101 of the MFD 10, in the chute 29. The pick-up roller 34 is rotatable about an axis which is perpendicular to the width direction 101 of the MFD 10. A part of the roller surface (i.e., the circumferential surface) of the pick-up roller 34 is exposed from the upper surface of the guide plate 30. The separation roller 34 is arranged at a position spaced from the pick-up roller on a downstream side, in the sheet feed direction 104. The separation roller is also rotatable about an axis perpendicular to the width direction 101 of the MFD 10, and a part of its roller surface is exposed from the upper surface of the guide plate 30.

Figure 3:
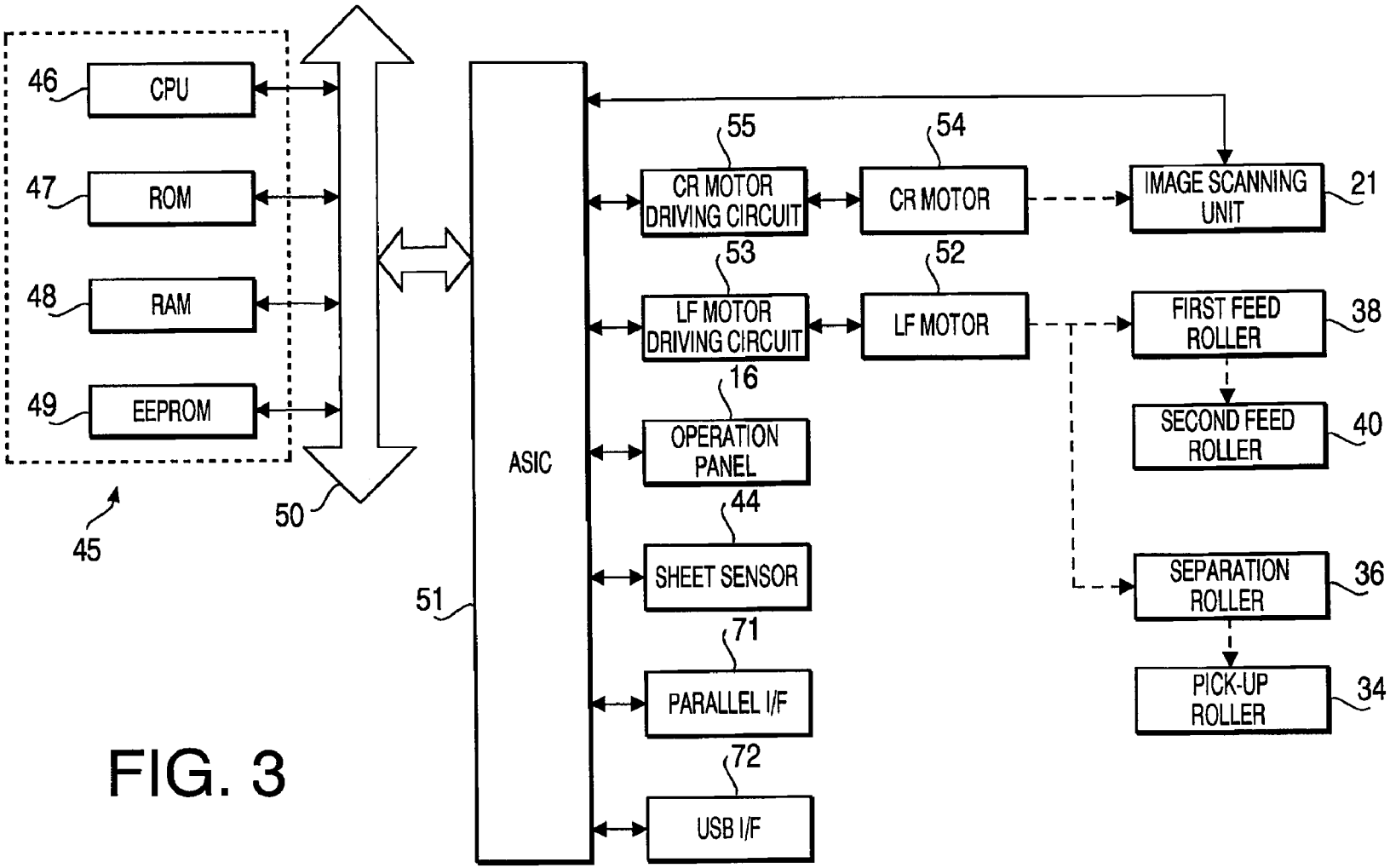
FIG. 3 is a block diagram showing a functional configuration of a controller of the MFD according to the embodiment of the invention.

The pick-up roller 34 and the separation roller 36 are driven to rotate as a driving force of an LF motor 52 (see FIG. 3) in a forward direction or a reverse direction is transmitted therefrom. According to the embodiment, the pick-up roller 34 and the separation roller 36 have the same diameter, and are rotated at the same rotation speed. Although not shown in the drawing, for transmitting the driving force from the LF motor 52 to the pick-up roller 34, a one-rotation clutch is interposed so that one idle rotation of the pick-up roller 34 is available.

The pick-up contact member 35 is provided to the partition plate 31 such that the pick-up contact member 35 faces the pick-up roller 34 and rockable in a direction where the pick-up contact member 35 can move toward/away from the pick-up roller 34. The pick-up contact member 35 is a pad-like member having a width slightly shorter than an axial length of the pick-up roller 34. An axis 35X of the rocking movement of the pick-up contact member 35 is fixed on the partition plate 31 (see FIGS. 5 and 6), and a downstream side end portion, in the sheet feed direction 104, of the pick-up contact member 35 moves toward/away from the circumferential surface of the pick-up roller 34. The pick-up contact member 35 is elastically urged by a spring (not shown) such that the pick-up contact member neutrally contacts the pick-up roller 34 when the original sheet is not nipped therebetween.

The separation contact member 37 is provided to the partition plate 31 such that the separation contact member 37 faces the separation roller 36 and rockable in a direction where the separation contact member 37 can move toward/away from the separation roller 36. The separation contact member 37 is a pad-like member having a width slightly shorter than an axial length of the separation roller 36. An axis 37X of the rocking movement of the separation contact member 37 is fixed on the partition plate 31 (see FIGS. 5 and 6), and a downstream side end portion, in the sheet feed direction 104, of the separation contact member 37 moves toward/away from the circumferential surface of the separation roller 36. The separation contact member 36 is elastically urged by a spring (not shown) such that the separation contact member 37 neutrally contacts the separation roller 36 when the original sheet is not nipped therebetween.

The feed roller 38 is provided on the upstream side, in the sheet feed direction 104, of the bent portion of the laterally-facing U-shape 32 of the sheet feed path 26. The driving force of the sheet feed roller 38 is also transmitted from the LF motor 52.

Above and below the sheet feed roller 38, pinch rollers 42 and 39 are arranged, respectively. The pinch rollers 39 and 42 are rotatably secured to the ADF body 27 and the ADF cover 28, respectively. Rotational shafts of the pinch rollers 39 and 42 are elastically urged by a spring member so that the pinch rollers 39 and 42 are press-contacted to the circumferential surface of the sheet feed roller 38. As the sheet feed roller 38 is driven to rotate, the pinch rollers 39 and 42 follow the rotation of the sheet feed roller 38 and rotate. When an original sheet is nipped between the pinch roller 39 (42) and the sheet feed roller 38, the original sheet is press-contacted to the sheet feed roller 38 and the rotational force thereof is transmitted to the original sheet nipped therebetween.

The feed roller 40 is arranged at a position close to the bent portion of the laterally-facing U-shape 32 of the sheet feed path 26. The feed roller 40 is driven to rotate by the driving force transmitted from the LF motor 52, similarly to the pick-up roller 34 and the separation roller 36.

Obliquely below the feed roller 40, a pinch roller 41 is provided. The pinch roller 41 is such that a rotation shaft of the pinch roller 41 is rotatably by the ADF main body 27. The rotation shaft is biased, by a spring member, toward the feed roller 40, thereby the pinch roller 41 is biased toward the feed roller 40. As the feed roller 40 rotates, the pinch roller 41 is driven to rotate. When an original sheet is nipped between the pinch roller 41 and the pick-up roller 40, the original sheet is press-contacted to the pick-up roller 40 and the rotational force thereof is transmitted to the original sheet nipped therebetween.

On the downstream side of the nip between the feed roller 38 and the pinch roller 42, a sheet ejection chute 33 is defined between the ADF cover 28 and the partition plate 31. The original sheet fed from the sheet feed tray 22 to the sheet feed path 26 passes the chute 29, the bent portion 32 and the ejection sheet chute 33, subsequently, and ejected on the sheet ejection tray 23.

An image scanner unit 21 is accommodated inside the scanning device 14. Although not shown in detail, the image scanner unit 21 has a CIS (Contact Image Sensor), a carriage and a scan mechanism. The CIS is a so-called contact type image sensor and configured to emit light to the original sheet and converts the light which is reflected by the original. The CIS is arranged to face a platen guide 43. The CIS extends in a direction of a width of the original sheet (i.e., perpendicular to a plane of FIG. 2) to scan a linear image, and a two-dimensional image is obtained as the original sheet is fed in the sheet feed direction 101.

The CIS is mounted on the carriage and arranged to contact a platen glass. The carriage is driven to move (scan) below the platen glass by the scan mechanism. When the scanner section 11 is used as the FBS, the CIS scans the image on the original sheet placed on the platen glass as the carriage is driven to translate along the platen glass. When the ADF 13 is used for scanning, the carriage is controlled to move to a position below the platen guide 43 and stay at the position, as shown in FIG. 2, while, as described above, the original sheet is fed below the platen guide 43, and the two-dimensional image on the original sheet is scanned by the CIS located below the platen guide 43.

According to the embodiment, the scanner section 11 can also be used as an FBS, therefore, the scanning unit 21 is configured to movable along the platen glass. It should be noted that the function of the FBS is an optional, and the scanner section 11 may be one employing the ADF 13 and unmovable CIS. In such a modification, the scanner unit 21 may be fixed to face the platen guide 43, and no mechanism for moving the scanner unit 21 is necessary. Further, the CIS may be replaced with a CCD (Charge Coupled Device) unit employing a reduction optical system, or any other known image scanning devices.

In the chute 29, a sheet sensor 44 is provided between the pick-up roller 34 and the separation roller 36. The sheet sensor 44 is configured to detect presence/absence of a sheet at a position where the sheet sensor 44 is provided. Although not shown in detail in the drawings, the sheet sensor 44 is, for example, configured to have a detection bar retractably protruded in the chute 29 and an optical sensor that optically detects change of posture of the detection bar and outputs an electrical signal representing the detection result. The detection bar of the sheet sensor 44 is urged by a spring to protrude in the chute 29 to interfere with an original sheet fed therein. When an original sheet is fed to contact the detection bar, the posture of the detection bar is changed by the original sheet, which is optically detected by the optical sensor.

Next, a controller 45 of the MFD 10 will be described. The controller 34 controls the entire operation of the MFD 10, i.e., both the scanner section 11 and the printer section 12. Since control of the printer section 12 is of conventionally known one, description thereof is omitted for brevity, and FIG. 3 does not show the control configuration of the printer section 12.

The controller 45 is a microcomputer including a CPU (Central Processing Unit) 46, a ROM (Read Only Memory) 47, a RAM (Random Access Memory) 48, an EEPROM (Electrically Erasable Programmable ROM) 49. The controller 45 is connected to an ASIC (Application Specific Integration Circuit) 51 via a bus 50 (see FIG. 3).

The ROM 47 stores programs, parameters and the like which are necessary for control various operations of the MFD 10. The RAM 48 is used as a work area and a temporary storage that temporarily stores various pieces of data necessitated by the CPU 46 when the various programs are executed.

The ASIC 51 generates PWM (Pulse Width Modulation) signals to be applied to the LF motor 52, under control of the CPU 46. The PWM signals are applied to the LF motor driving circuit 53, which applies a drive signal to the LF motor 52, thereby the rotation of the LF motor 52 is controlled.

The driving circuit 53 is for driving the LF motor 52. The driving circuit 53 receives the output signal of the ASIC 51 and generates an electrical signal for rotating the LF motor 52. The LF motor 52 rotates when the electrical signal is applied by the ASIC 51. Then, via a driving mechanism of well-known configuration (e.g., one including gears, driving shafts, etc.), the rotational force of the LF motor 52 is transmitted to the separation roller 36 and the feed roller 38. The driving force of the pick-up roller 34 is transmitted from the separation roller 36, via a transmission mechanism of well-known configuration.

The ASIC 51 generates, under control of the CPU 46, the PWM signals to be applied to the CR motor 54. The PWM signal generated by the ASIC 51 is applied to a driving circuit 55 of the CR motor. Then, the driving circuit 55 applies a driving signal to the CR motor 54. Thus, the rotation of the CR motor 54 is controlled by the CPU 46.

The driving circuit 55 is for driving the CR motor 54, and generates an electrical signal for rotating the CR motor 54 as the output signal of the ASIC 51 is received. When the electrical signal generated by the driving circuit 55 is applied, the CR motor 54 rotates. The rotational force of the CR motor 54 is transmitted to the scanning unit 21 via a scanning mechanism of a conventional type, thereby the scanning unit 21 is moved for scanning.

The sheet sensor 44 is connected to the ASIC 51. Further, the operation panel 16, a parallel interface 71 and a USB interface 72 allowing the ASIC 51 to execute data communication with external devices with use of parallel cables and/or USB cables are also connected to the ASIC 55.

Next, a sheet feed process executed by the ADF 13 will be described. According to the embodiment, the controller 45 controls the pick-up roller 34 and the separation roller 36 to rotate in a rotation direction (which will be referred to as a reverse direction) that is a rotation direction opposite to a rotation direction (which will be referred to as a forward direction) for feeding the original sheet in the feeding direction 104 on condition that the sheet sensor 44 detects the stack 60 of the original sheets. Thereafter, when the sheet sensor 44 detects the absence of the sheets, the controller 45 controls the pick-up roller 34 and the separation roller 36 to stop rotating, and then to start rotating in the forward direction so that one of the original sheets stacked on the sheet feed tray 22 in the sheet feed path 26 is fed.

Hereafter, the sheet feed process will be described in detail. When the image scanning is performed using the ADF 13, a user closes the original holding cover 15 with respect to the scanning device 14 as shown in FIG. 1. Then, the user place the stacked original sheets 60 to be scanned on the sheet feed tray 22. When placed on the sheet feed tray 22, the leading ends, in the sheet feed direction 104, of the stacked original sheets 60 are aligned to be flattened, and the leading ends of the stacked original sheets 60 are manually inserted into the chute 29 from the sheet feed tray 22.

When the stacked original sheets 60 are inserted into the chute 29, the original sheets first contact the pick-up roller 34 and the pick-up contact member 35. At this stage, one idle rotation of the pick-up roller 34 in the forward direction is available. As the stacked original sheets 60 are being further inserted, the leading end portions of the stacked original sheets 60 cause the pick-up roller 34 to idly rotate, and the pick-up contact member 35 to be retracted against the urging force of the spring member. At this stage, the pick-up roller 34 which contacts the lowermost sheet of the stacked original sheets 60 is idly rotated. Therefore, the elastic urging force of the spring that urges the pick-up contact member 35 toward the pick-up roller 34 is applied to the stacked original sheets 60 as a resisting force. By adjusting the elastic force of the spring member appropriately, the user can insert the stacked original sheets 60 further with substantially feeling no resisting force. Therefore, the use would not misrecognize that the stacked original sheets 60 have been fully inserted when the leading ends of the stacked original sheets 60 contact the pick-up roller 34 and the pick-up contact member 35. It should be noted that, the pick-up contact member 35 should be configured to press the stack of the original sheets 60 from the above so that the stacked original sheets 60 is press-contacted to the pick-up roller. However, the urging force to be applied by the pick-up contact member 35 needs not be excessively strong to cause the user to feel the resisting force when inserting the stacked original sheets 60 since the gravity force applied to the stacked original sheets 60 also works to urge the stacked original sheets 60 to the pick-up roller 34.

Thereafter, the leading ends of the stacked original sheets 60 come to contact the separation roller 36 and the separation contact member 37. Since the shaft 62 of the separation roller 36 is applied with load of the transmission mechanism that transmits the driving force of the LF motor 52, in order to further insert the stacked original sheets 60, it is necessary to rotate the separation roller 36 against the load applied to the shaft 62 or make the stacked original sheets 60 slide on the roller surface (i.e., the circumferential surface) of the separation roller 36. Due to the load and/or sliding frictional force, the user feels resistance in inserting the stacked original sheets 60. Because of the resistance, the user recognizes that setting of the stacked original sheets 60 has been completed. Thus, setting of the stacked original sheets 60 is finished with a state where the stacked original sheets 60 are placed on the sheet feed tray 22 with the leading end portion of the stacked original sheets 60 being inserted in the chute 29.

Figure 5:
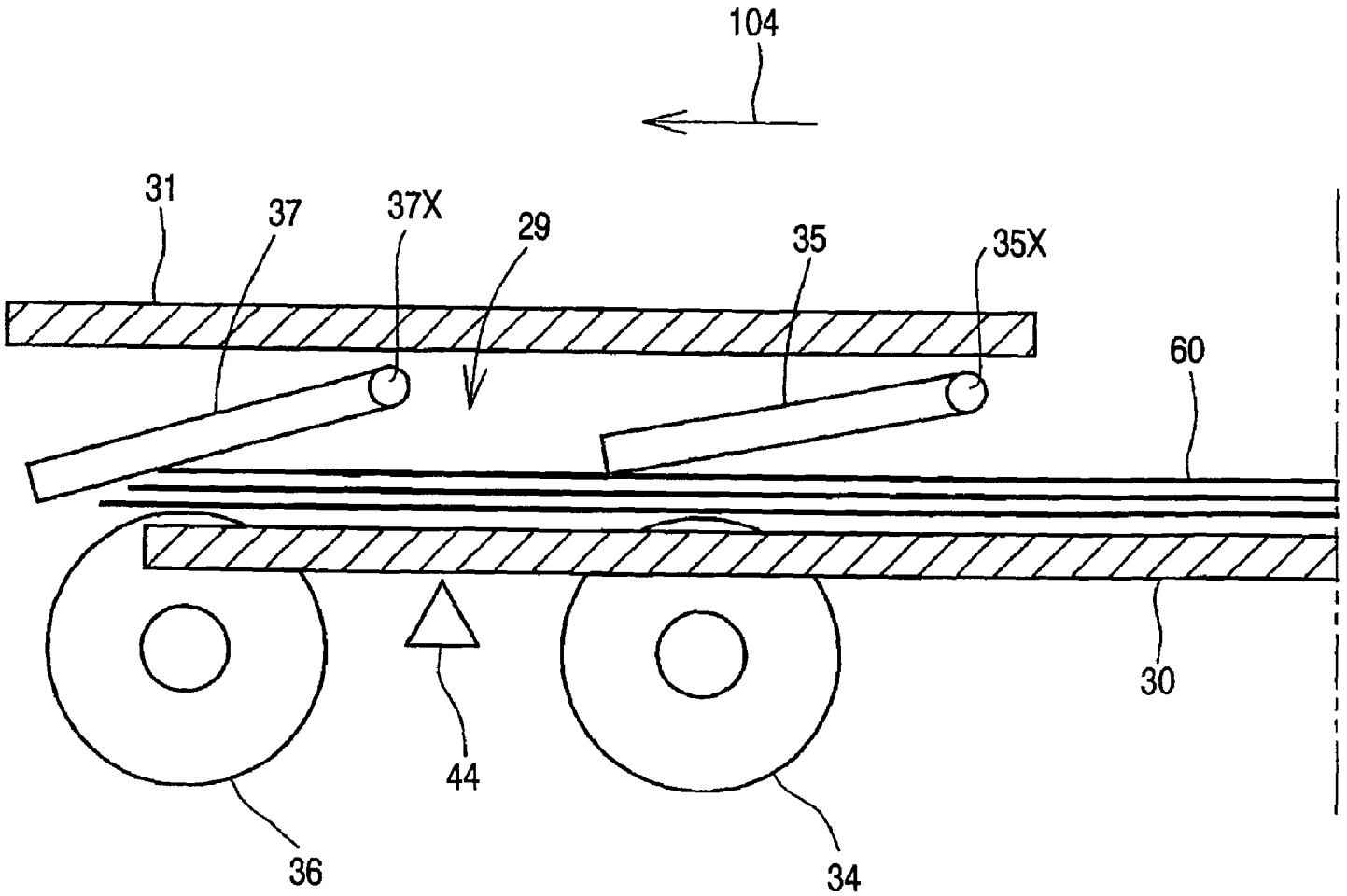
FIG. 5 is a partial cross-sectional side view of the MFD taken along line II-II of FIG. 1 and when a stack of sheets are placed.

When the user loads the stacked original sheets 60 as described above, if the user insert the stacked original sheets 60 in the chute 29 with great force, the leading ends of the stacked original sheets 60 may pass through the nip between the separation roller 36 and the separation contact member 37 slightly, as shown in FIG. 5. If the original sheets are fed forward for scanning in such a state, multiple original sheets may be fed simultaneously (i.e., the uppermost sheet may not be separated from the remaining sheets). According to the embodiment, such a problem is resolved by feeding the original sheets backward, which will be described below.

After the stacked original sheets 60 have been set to the MFD 10, the user instructs the MFD 10 to start scanning of the original sheets with use of the operation panel 16 or the PC connected to the MFD 10. When the user starts the scanning operation using the operation panel 16, the user operates a start button provided to the operation panel 16 to instruct the MFD 10 to, and start of scanning is instructed when the user depresses the start button. When the user uses the PC connected to the MFD 10, a virtual start button may be displayed on a display device of the PC and the start of the scanning operation is instructed to the MFD 10 when the user operates the virtual start button (i.e., clicks the virtual start button displayed on the display device).

Figure 4:
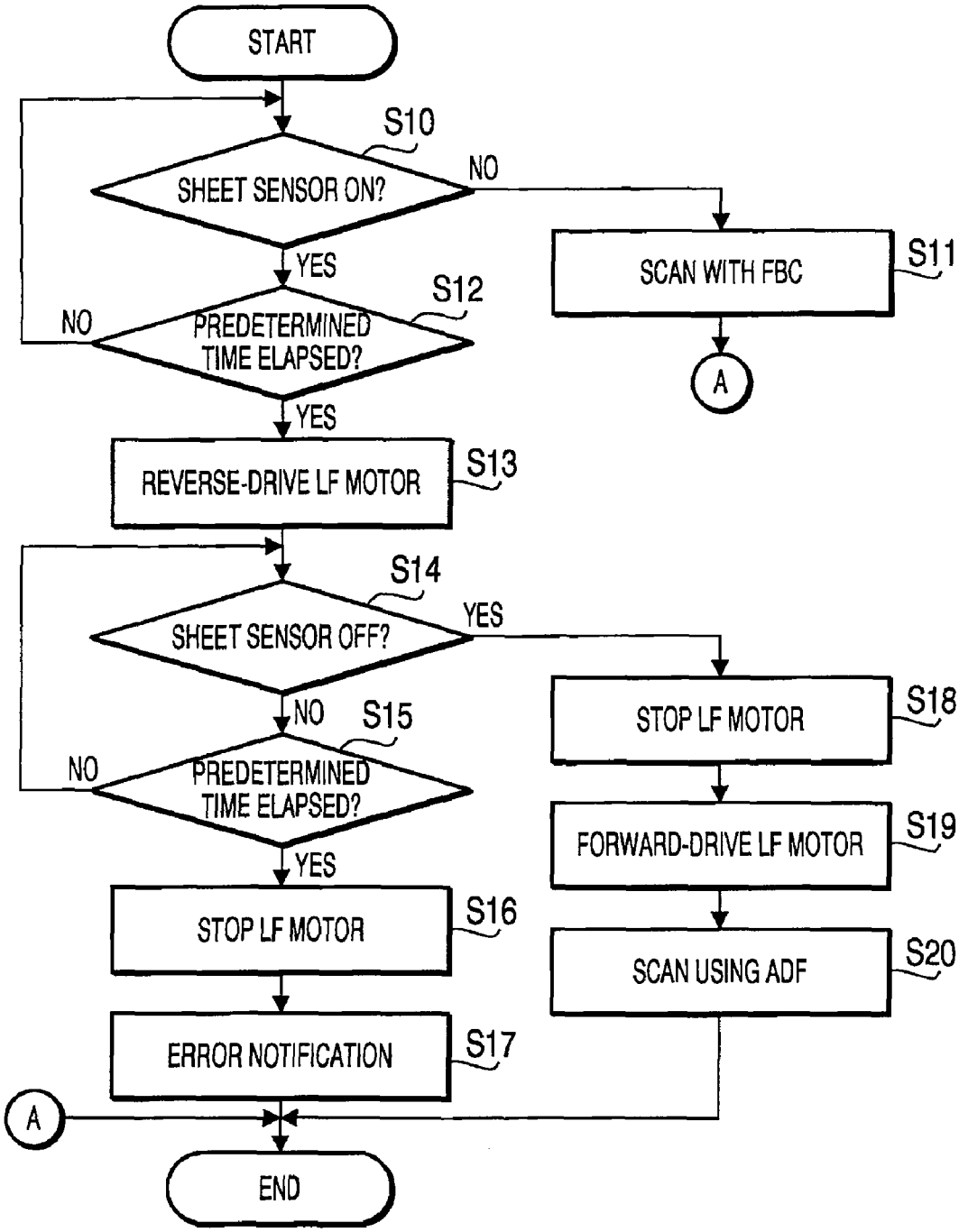
FIG. 4 is a flowchart illustrating a sheet feed process performed by the ADF of the MFD according to the embodiment of the invention.

When the start instruction is received, the controller 45 of the MFD 10 starts an original sheet feed process of the ADF 13 (see FIG. 4) on condition that the sheet sensor 44 detects presence of the stacked original sheets 60 (S10: YES). If the sheet sensor 44 does not detect the presence of the original sheets 60 (S10: NO) when the controller 45 receives the start instruction, the controller 45 does not feed the original sheets using the ADF 13, and moves the image scanning unit 21 with respect to the scanning device 14 to start scanning of the original sheet placed on the scanning device 14 (S11).

If the sheet sensor 44 detects the presence of the stacked original sheets 60 (S10: YES), and a predetermined period has elapsed (S12: YES), the controller 45 controls the drive circuit 53 to reverse rotate the LF motor 52 (S13). The reverse rotation of the LF motor 50 is transmitted to the separation roller 36, which rotates in reverse direction (i.e., in a direction where the stacked original sheets 60 are fed in a direction opposite to the feed direction 104). In FIG. 5, the reverse direction of the separation roller is a clockwise direction. In association with the rotation of the separation roller 36, the pick-up roller 34 is also rotated in the reverse direction (i.e., a direction in which the pick-up roller 34 feeds the original sheets in a direction opposite to the sheet feed direction 104).

In S12, the controller 45 waits for the elapse of the predetermined period. This waiting time period is provided considering a case where the user sets the stacked original sheets 60 to the ADF 13 and removes the same immediately as the user erroneously or unintentionally sets the stacked original sheets 60. If such a problem would not occur, the elapse of the predetermined period can be ignored (S12 can be omitted) and the controller 45 may rotate the LF motor 52 immediately when the sheet sensor 44 detects the presence of the stacked original sheets 60.

Figure 6:
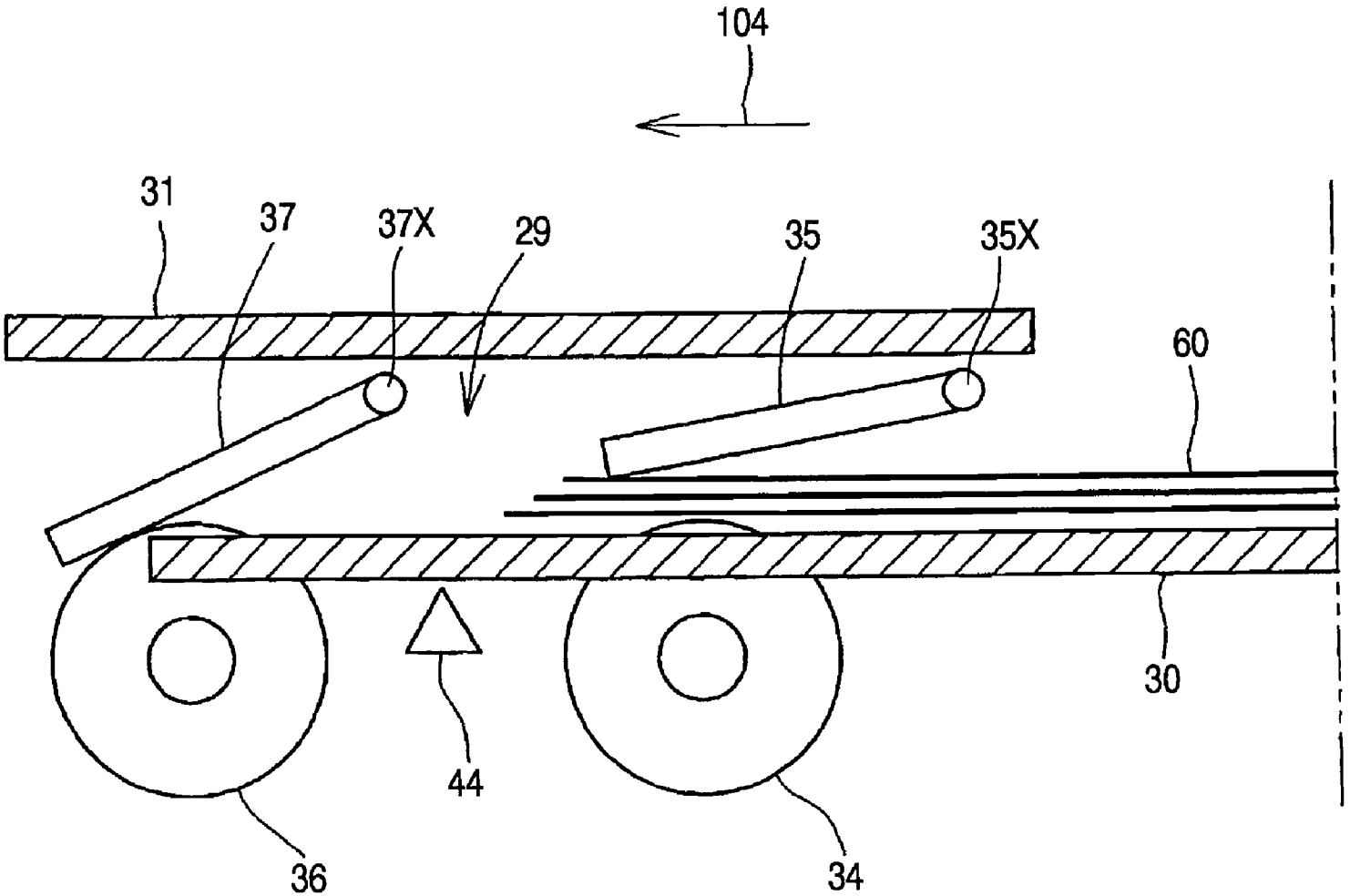
FIG. 6 is a partial cross-sectional side view of the MFD taken along line II-II of FIG. 1 and when a stack of sheets are reversely moved.

When the pick-up roller and the separation roller are reversely rotated, the stacked original sheets 60 passed through the nip between the separation roller 36 and the separation contact member 37 are fed backward so that the leading ends thereof is reversely fed toward the pick-up roller 34. When the sheet sensor 44 detects the absence of the stacked original sheets 60 (S14: YES), i.e., when a detection status of the stacked original sheets 60 is changed from "present" to "absent," the controller 44 stops the LF motor 52. Therefore, the pick-up roller 26 and the separation roller stop rotating. It should be appreciated that the timing at which the rotation of the LF motor 34 and the separation roller 36 are stopped is before the leading ends or the stacked original sheets 60 are moved on the sheet feed tray 22 side with respect to the nip between the pick-up roller 34 and the pick-up contact member 35. Therefore, by the reverse feeding movement, the leading ends of the stacked original sheets 60, which have passed the nip between the separation roller 36 and the separation contact member 37 are located between the nip of the pick-up roller 34. In other words, the stacked original sheets 60 are reversely fed so as to be nipped only by the pick-up roller 34 and the pick-up contact member 35, as shown in FIG. 6.

The controller 45 stops the reveres rotation of the LF motor 52 (S16) on condition that the sheet sensor 44 keeps detecting the presence of the stacked original sheets 60 (S14: YES; S15: YES) while the LF motor 52 is kept rotated reversely for a predetermined period (S15: NO). Such a condition occurs when the stacked original sheets 60 are not fed reversely, toward the sheet feed tray 22 even if the pick-up roller 34 and the separation roller 36 are reversely rotated. Therefore, in such a case, the controller 45 displays an error message on the display of the operation panel 16 (S17), and stop the reverse feeding of the stacked original sheets 60. Optionally, this termination of the reverse feeding may be restarted in response to an error release operation.

If the sheet sensor 44 detects the absence of the stacked original sheets 60 (S14: YES) during the reverse feeding of the stacked original sheets 60, the controller 45 stops the LF motor 52 (S18). Thereafter, the controller 45 controls the driving circuit 53 to rotating the LF motor 52 normally (S19). The forward rotation of the LF motor 52 is transmitted to the separation roller 36, and the separation roller 36 also rotates forwardly, in a direction where the stacked original sheets 60 are fed in the feeding direction 104 (i.e., in a counterclockwise direction in FIG. 5). In association with the rotation of the separation roller 36, the pick-up roller 34 also rotates forwardly. Since the reverse feeding of the stacked original sheets 60 is terminated when the sheet sensor 44 detects the absence of the stacked original sheets 60, the reverse feeding is executed only for a time period necessary to reversely feed the stacked original sheets 60.

The stacked original sheets 60 are urged, as a whole, by the pick-up contact member 35 toward the pick-up roller 34. However, only the lowermost sheet of the stacked original sheets 60 directly contacts the roller surface of the pick-up roller 34, only the lowermost sheet receives the rotational force of the pick-up roller 34 and fed in the feeding direction 104. Thus, the leading end of the lowermost original sheet enters the nip between the separation roller 36 and the separation contact member 37, and nipped thereby. As the lowermost original sheet is urged toward the roller surface of the separation roller 36 by the separation contact member 37, and receives the rotational force of the separation roller 36, the lowermost original sheet is further fed in the feeding direction 104.

When the lowermost sheet of the stacked original sheets 60 is fed, one or more sheets above the lowermost original sheet may be fed together, in an overlapped stated, due to electrostatic action. According to the embodiment, however, even if two or more sheets enter between the separation roller 36 and separation contact member 37, only the lowermost sheet directly receives the rotational force of the pick-up roller 34 and the separation roller 36, the lowermost original sheet is separated from the other sheets and introduced in the sheet feed path 26. Then, the image on the original sheet 26 successfully introduced in the sheet feed path 26 is scanned by the image scanning unit 21 (S20).

In the above embodiment, the controller 45 starts feeding the original sheets on condition that the sheet sensor 44 detects the presence of the stacked original sheets 60. Therefore, the sheet feeding operation will not be executed when the stacked original sheets 60 are not inserted in the chute 29. In addition, the sheet sensor 44 is also used for judging whether the leading ends of the stacked original sheets 60 are reversely fed and located on the upstream side of the separation roller 36. Therefore, without increasing the number of sensors, the sheet feed process can be executed.

Due to slippage between the separation roller 36 and the stacked original sheets 60 and/or jammed condition, the stack of the leading ends of the original sheets 60 may not be reversely fed toward the pick-up roller 34 even if the pick-up roller 34 and the separation roller 36 are reversely rotated. According to the embodiment, in such a state, the sheet sensor 44 keeps detecting the presence of the stacked original sheets 60 and thus occurrence of such an error can be detected. Accordingly, the controller 45 can stop feeding the sheets when the error occurs and display an error message informing a user of necessity of restoring action.

What is claimed is:

1. A sheet feeding device configured to feed stacked sheets one by one, comprising:

a sheet feed tray configured to hold a plurality of sheets stacked on the sheet feed tray;

a chute having a first guide and a second guide opposing the first guide;

a first roller arranged on the first guide with at least part of a roller surface thereof being exposed;

a first contact member arranged to protrude from the second guide, the first contact member being urged so as to contact the first roller;

a second roller arranged on the first guide with at least part of the second roller being exposed;

a second contact member arranged to protrude from the second guide, the second contact member being urged so as to contact the second roller;

a motor coupled to the first roller and the second roller, the motor configured to rotate the first roller and the second roller;

a sensor arranged between the first roller and the second roller and configured to send a signal when the sensor detects a sheet; and a controller coupled to the motor and the sensor and configured to control the motor to rotate the first roller and the second roller in a first direction in which the sheet is fed from the second roller to the first roller when the controller receives a signal from the sensor, the controller controlling the motor to stop the rotation of the first roller and the second roller when the signal from the sensor is terminated, and then rotate the first roller and the second roller in a second direction in which the sheet is fed from the first roller to the second roller.

2. The sheet feeding device according to claim 1, wherein the controller stops the rotation of the first roller and the second roller if the controller keeps receiving, from the sensor, the signal representing a presence of the sheet for a predetermined period after the controller controls the motor to start rotating the first roller and the second roller to feed the sheet from the second roller to the first roller.

3. The sheet feeding device according to claim 1, wherein the controller is further configured to notify an occurrence of an error if the controller keeps receiving, from the sensor, the signal representing the presence of the sheet for a predetermined period after the controller controls the motor to start rotating the first roller and the second roller to feed the sheet from the second roller to the first roller.

4. An imaging apparatus, comprising:

a sheet feeding device configured to feed a plurality of sheets to be used in the imaging apparatus, and a scanning unit configured to scan images formed on the plurality of sheets fed from the tray, wherein the sheet feeding device includes:

a sheet feed tray configured to hold a plurality of sheets stacked on the sheet feed tray;

a chute having a first guide and a second guide opposing to the first guide;

a first roller arranged on the first guide with at least part of a roller surface thereof being exposed;

a first contact member arranged to protrude from the second guide, the first contact member being urged so as to contact the first roller;

a second roller arranged on the first guide with at least part of the second roller being exposed;

a second contact member arranged to protrude from the second guide surface, the second contact member being urged so as to contact the second roller;

a motor coupled to the first roller and the second roller, the motor configured to rotate the first roller and the second roller;

a sensor arranged between the first roller and the second roller and configured to send a signal when the sensor detects a sheet; and a controller coupled to the motor and the sensor and configured to control the motor to rotate the first roller and the second roller in a first direction in which the sheet is fed from the second roller to the first roller when the controller receives a signal from the sensor, the controller controlling the motor to stop the rotation of the first roller and the second roller when the signal from the sensor is terminated, and then rotate the first roller and the second roller in a second direction in which the sheet is fed from the first roller to the second roller.

5. The imaging apparatus according to claim 4, wherein the controller stops the rotation of the first roller and the second roller if the controller keeps receiving, from the sensor, the signal representing a presence of the sheet for a predetermined period after the controller controls the motor to start rotating the first roller and the second roller to feed the sheet from the second roller to the first roller.

6. The imaging apparatus according to claim 4, wherein the controller is further configured to notify an occurrence of an error if the controller keeps receiving, from the sensor, the signal representing the presence of the sheet for a predetermined period after the controller controls the motor to start rotating the first roller and the second roller to feed the sheet from the second roller to the first roller.

7. A method of feeding a plurality of sheets stacked on a sheet feed tray one by one in a first direction to introduce the sheet into a device with use of a first roller and a second roller arranged inside the device along the first direction, comprising the steps of:

feeding the sheet in a second direction opposite to the first direction;

continuing the feeding of the sheet in the second direction if a presence of the sheet at a predetermined position defined between the first roller and the second roller is detected and a predetermined period has not elapsed since a start of the feeding of the sheet in the second direction;

terminating the feeding of the sheet in the second direction if the presence of the sheet at the predetermined position is detected and the predetermined period has elapsed since the start of the feeding of the sheet in the second direction;

terminating the feeding of the sheet in the second direction if an absence of the sheet at the predetermined position is detected before the predetermined period has elapsed since the start of the feeding of the sheet in the second direction; and feeding the sheet in the first direction if the feeding of the sheet in the second direction is terminated when the absence of the sheet at the predetermined position is detected before the predetermined period has elapsed since the start of the feeding of the sheet in the second direction.

* * * * *